US006200395B1

(12) United States Patent
DeArdo et al.

(10) Patent No.: US 6,200,395 B1
(45) Date of Patent: Mar. 13, 2001

(54) FREE-MACHINING STEELS CONTAINING TIN ANTIMONY AND/OR ARSENIC

(75) Inventors: Anthony J. DeArdo; C. Isaac Garcia, both of Pittsburgh, PA (US)

(73) Assignee: University of Pittsburgh - of the Commonwealth System of Higher Education, Pittsburgh, PA (US)

( * ) Notice: Subject to any disclaimer, the term of this patent is extended or adjusted under 35 U.S.C. 154(b) by 0 days.

(21) Appl. No.: 09/320,416

(22) Filed: May 26, 1999

Related U.S. Application Data

(63) Continuation-in-part of application No. 08/972,154, filed on Nov. 17, 1997, now Pat. No. 5,961,747.

(51) Int. Cl.[7] ..... C22C 38/60; C22C 38/16; C22C 6/06

(52) U.S. Cl. ..... 148/332; 148/320; 148/660; 420/87; 420/89; 420/8

(58) Field of Search ..... 420/8, 87, 88, 420/89, 129; 148/320, 332, 579, 660

(56) References Cited

U.S. PATENT DOCUMENTS

| | | | |
|---|---|---|---|
| 3,853,544 | 12/1974 | Nishi et al. | 75/125 |
| 3,973,950 | 8/1976 | Itoh et al. | 75/123 D |
| 4,247,326 | 1/1981 | Quinto et al. | 75/123 AA |

(List continued on next page.)

FOREIGN PATENT DOCUMENTS 56-84448 7/1981 (JP) .

OTHER PUBLICATIONS

Kazuaki Iwata, "The Effect of Lead on Crack Behavior of leaded Free Machining Steel During Controlled Cutting Temperature Micro–Machining." Department of Mechanical Engineering, Kobe University, Rokko, Nada, Zkobe 657, Japan, 1976.*

H. J. Grabke, "Surface and Grain Segregation on and in Iron and Steels," *ISIJ International*, vol. 29, No. 7, pp. 529–538 (1989).

M. P. Seah, "Adsorption–Induced Interface Decohesion," *Acta Metallurgica*, vol. 28, pp. 955–962 (1980).

E. D. Hondros, "Interfacial Energies and Composition in solids," Proceedings of TMS–AIME Heat Treatment Committee Symposium—Precipitation Processes In Solids, Niagara Falls, New York, Sep. 20–21, 1976.

T. J. Baker, "Use of Scanning Electron Microscopy in Studying Sulphide Morphology on Fracture Surfaces," Proceedings of an American Society of Metals International Symposium, Port Chester, New York, Nov. 7–8, 1974.

L. K. Bigelow and M.C. Flemings, "Sulfide Inclusions in Steel," *Metallurgical Transactions B*, vol. 6B, pp. 275–283 (Jun. 1975).

*Primary Examiner*—Deborah Yee
(74) *Attorney, Agent, or Firm*—Metz Schermer & Lewis, LLC; Leland P. Schermer; Thomas Lizzi

(57) ABSTRACT

The invention relates to free-machining steels which do not rely on lead as a means of enhancing machinability. Instead, the steels of the invention employ concentrations of tin, arsenic, and/or antimony at ferrite grain boundaries to replicate a role of lead, which the inventors have discovered, in enhancing machinability. This role is to cause an embrittlement at the localized cutting zone temperatures by changing the fracture mode from transgranular to intergranular at those temperatures. The invention's use of concentrations of tin, arsenic, and/or antimony at the ferrite grain boundaries of the steel permits the machinability-enhancing effect to be obtained while employing bulk contents of tin, arsenic, and/or antimony below the levels at which hot tearing becomes problematic. The invention improves over lead-bearing, free-machining steels in that the machinability-enhancing embrittlement produced by concentrating tin, arsenic, and/or antimony at the ferrite grain boundaries is both controllable and reversible. The invention also relates to methods of producing the described free-machining steels and the products of those processes.

102 Claims, 3 Drawing Sheets

U.S. PATENT DOCUMENTS

| | | | |
|---|---|---|---|
| 4,255,187 | 3/1981 | Bhattacharya et al. | 75/123 AA |
| 4,255,188 | 3/1981 | Riekels | 75/123 AA |
| 4,279,646 | 7/1981 | Kato et al. | 75/123 AA |
| 4,302,248 | 11/1981 | Kasamatsu et al. | 75/128 A |
| 4,394,168 | 7/1983 | Hartvig et al. | 75/126 A |
| 4,661,174 | 4/1987 | Miyoshi et al. | 148/111 |
| 4,670,065 | 6/1987 | Yasuda et al. | 148/2 |
| 4,719,079 | 1/1988 | Katayama et al. | 420/84 |
| 4,786,466 | 11/1988 | Holowaty | 420/84 |
| 4,806,304 | 2/1989 | Kimura et al. | 420/84 |
| 4,880,479 | 11/1989 | Birman et al. | 148/320 |
| 4,975,127 | 12/1990 | Kurosawa et al. | 148/111 |
| 5,102,479 | 4/1992 | Nakamura et al. | 148/333 |
| 5,125,991 | 6/1992 | Ishitobi et al. | 148/308 |
| 5,139,582 | 8/1992 | Kurosawa et al. | 148/111 |
| 5,173,128 | 12/1992 | Komatsubara et al. | 148/111 |
| 5,181,972 | 1/1993 | Komatsubara et al. | 148/111 |
| 5,213,633 | 5/1993 | Hada et al. | 148/334 |
| 5,244,511 | 9/1993 | Komatsubara et al. | 148/111 |
| 5,288,455 | 2/1994 | Siga et al. | 420/83 |
| 5,330,586 | 7/1994 | Komatsubara et al. | 148/111 |
| 5,360,676 | 11/1994 | Kuguminato et al. | 428/682 |
| 5,415,703 | 5/1995 | Ushigami et al. | 148/308 |
| 5,421,911 | 6/1995 | Schoen | 148/111 |
| 5,512,110 | 4/1996 | Yoshitomi et al. | 148/113 |
| 5,558,726 | 9/1996 | Yatoh et al. | 148/328 |
| 5,562,783 | 10/1996 | Inoue et al. | 148/310 |
| 5,645,794 | 7/1997 | Beguinot et al. | 420/106 |
| 5,665,178 | 9/1997 | Komatsubara et al. | 148/111 |
| 5,702,541 | 12/1997 | Inokuti | 148/308 |
| 5,718,775 | 2/1998 | Komatsubara et al. | 148/308 |
| 5,776,267 | 7/1998 | Nanba et al. | 148/328 |
| 5,807,441 | 9/1998 | Tomida et al. | 148/113 |
| 5,855,694 | 1/1999 | Toge et al. | 148/111 |
| 5,858,126 | 1/1999 | Takashima et al. | 148/308 |
| 5,885,374 | 3/1999 | Ishitobi et al. | 148/308 |
| 5,888,314 | 3/1999 | Ushigami et al. | 148/113 |

* cited by examiner

FREE-MACHINING STEELS CONTAINING TIN ANTIMONY AND/OR ARSENIC

CROSS-REFERENCE TO RELATED APPLICATION

This is a continuation-in-part of the application Ser. No. 08/972,154, filed Nov. 17, 1997, now U.S. Pat. No. 5,961, 747 issued Oct. 5, 1999.

BACKGROUND OF THE INVENTION

1. Field of the Invention

The present invention relates to a free-machining steel which does not rely on lead as a means of enhancing machinability. More specifically, the invention relates to a free-machining steel having a concentration of tin, antimony, and/or arsenic at the ferrite grain boundaries of the steel which has machinability comparable to, or better than, that of conventional lead-bearing free-machining steels. The present invention also relates to a process for producing such free-machining steels.

2. Description of the Related Art

Free-machining steels are utilized in the machining of various components by means of fast-cutting machine-tools. Free-machining steels are characterized by good machinability, that is, (i) by their ability to cause relatively little wear on the cutting tool thereby extending the useful life of the cutting tool and (ii) by high surface quality. Low tool wear permits the use of higher cutting speeds resulting in increased productivity. The extended cutting tool life further reduces production costs by allowing savings in the cost of cutting tools and in the avoidance of the down time associated with changing cutting tools.

Machinability is a complex and not fully understood property. A full understanding of machinability would require taking into account a multitude of factors, including the effect of the steel composition, the elastic strain, plastic flow, and fracture mechanics of the metal workpiece, and the cutting dynamics that occur when steel is machined by cutting tools in such operations as turning, forming, milling, drilling, reaming, boring, shaving, and threading. Due to the complexities of the cutting process and the inherent difficulties in making real time observations at a microscopic level, knowledge of the extent of the range of mechanisms that affect machinability is also incomplete.

Metallurgists have long assumed that improvements in the machinability of free-machining steels could be obtained by modifying the chemical composition of those steels to optimize the size, shape, distribution, and chemical composition of inclusions to enhance brittleness of the chip and to increase lubrication at the tool/chip interface. They have also sought to prevent the formation of abrasive inclusions which could increase tool wear.

Accordingly, it has been common to use free-machining steels in which soft inclusions, such as manganese sulfide, are dispersed. The manganese sulfide inclusions extend cutting tool service life by bringing about effects such as crack propagation, decrease of cutting tool wear through tool face lubrication, and prevention of cutting edge buildup on the cutting tools. In contrast, hard oxide or carbonitride inclusions, such as silicon oxide, aluminum oxide, titanium oxide, titanium carbonitride, which have hardnesses higher than that of the cutting tool, act like fine abrasive particles to abrade and damage the cutting tool thereby decreasing its service life. Thus, free-machining steels are generally not subjected to strong deoxidation during steelmaking so as to keep the content of hard inclusions low.

Historically, lead has been added to free-machining steels containing manganese sulfide inclusions to enhance the machinability of those steels. However, the use of lead has serious drawbacks. Lead and lead oxides are hazardous. Caution must be taken during steelmaking and any other processing steps involving high temperatures. Such process steps produce lead and/or lead oxide fumes. Atmosphere control procedures must be incorporated into high temperature processing of lead-bearing steels. Disposal of the machining chips from lead-bearing free-machining steels is also problematic due to the lead content of the chips. Another serious disadvantage is that lead is not uniformly distributed throughout conventional steel products. This is because lead is not soluble in the steel and, due to its high density, it settles out during the teeming and solidification processes, resulting in segregation or non-uniform distribution within the steel.

Lead's ability to enhance machinability has been attributed to effects that flow from a combination of lead's low melting temperature and its propensity to surround manganese sulfide inclusions as a soft phase. Thus, previous efforts to replace lead in free-machining steels have focused on replicating this combination of characteristics. Consequently, face-machining steels were developed in which a soft phase, such as a low melting metal like bismuth or a plastic oxide, such as a complex oxide containing calcium, took the place of lead in surrounding the manganese sulfide inclusions.

SUMMARY OF THE INVENTION

The inventors have discovered a critical role that lead plays in enhancing the machinability of free-machining steels that is unrelated to lead's propensity to form a soft phase around sulfide inclusions. The inventors have discovered that lead causes an embrittling effect in free-machining steels at temperatures corresponding to the localized cutting zone temperatures which occur during machining. Through the use of hot compression tests, the inventors have discovered that, for lead-bearing free-machining steels, an embrittlement trough in the temperature range of about 200° C. to about 600° C. occurs in which the fracture mode changes from a relatively ductile transgranular mode to a relatively brittle intergranular mode. FIG. 1 shows a graph of hot compression test results for two similar grades of conventional free-machining steels, one of which, AISI grade 12L14, contains lead, and the other, AISI grade 1215, does not. The deep trough in the graph for the lead-bearing 12L14 grade indicates an embrittlement region. Through microscopic examination of fracture surfaces, the inventors discovered that the embrittlement of the lead-bearing 12L14 grade was due to a change in fracture mode in the embrittlement temperature zone from transgranular to intergranular fracture.

The inventors further discovered that lead causes this embrittling change of fracture mode by being present at, and weakening, the ferrite grain boundaries of lead-bearing free-machining steel. Thus, the inventors discovered that lead resides at ferrite grain boundaries of the steel where, due to its effect on lowering the grain boundary cohesive strength, it causes the fracture mode to change from transgranular to intergranular in the temperature range corresponding to the localized temperatures occurring in the cutting zone during machining. Brittle, intergranular fracture requires relatively little energy input compared to ductile, transgranular fracture. Accordingly, the inventors further discovered that lead, by acting to embrittle the steel at the localized machining temperatures, improved machinability by reducing the energy input from the cutting tool necessary for cutting the steel, thereby resulting in less cutting tool wear.

Importantly, because of their discovery of this mechanism by which lead operates to improve the machinability of free-machining steels, the inventors were able to discover and solve a problem that was previously unrecognized by those skilled in the art. The inventors discovered that a problem to be solved in finding a substitute for lead in free-machining steels was to determine what could replace lead as an agent that resides at the ferrite grain boundaries to cause the fracture mode to change from transgranular to intergranular in the temperature range corresponding to the localized temperatures occurring in the cutting zone during machining. This discovery enabled the inventors to invent the free-machining steels of the present invention upon making their subsequent discovery that tin could act as such an agent and thus replace lead as a machinability enhancer in free-machining steels. Thus, the inventors made the surprising discovery that tin could replicate a machinability-enhancing effect of lead in free-machining steels.

Furthermore, the inventors have discovered that the machinability-enhancing effectiveness of a relatively small amount of tin could be amplified through the use of thermal practices which act to concentrate tin at ferrite grain boundaries of the steel. By employing such a concentration of tin at the ferrite grain boundaries, the inventors have been able to avoid the deleterious effects, such as hot tearing, which occur with higher bulk tin contents.

Additionally, the inventors discovered the surprising result that the machinability-enhancing embrittling effect in the temperature range of localized machining temperatures, which results from the concentration of tin at the ferrite grain boundaries, can be substantially reversed through the use of thermal practices which act to redistribute the tin more homogeneously throughout the steel. Thus, the inventors have discovered that, through a first thermal practice, the machinability of the steel can be improved by causing an embrittlement in the temperature range of localized machining temperatures by concentrating tin at ferrite grain boundaries of the steel, and then, through a second thermal practice conductible after machining, this embrittlement can be controllably removed by redistributing the tin from ferrite grain boundaries more homogeneously throughout the steel. In other words, the inventors made the surprising discovery of how to controllably enhance the machinability of the steel by reversibly concentrating tin at ferrite grain boundaries of the steel.

An object of the present invention is to provide machinability in free-machining steels comparable to or better than that of lead-bearing, free-machining steels without the need to rely on lead for enhancing machinability and thereby avoid the objectionable disadvantages that accompany the use of lead.

A further object of the invention is to produce a free-machining steel having a substitute for lead which replicates the role of lead at ferrite grain boundaries of the steel in causing a change in fracture mode from transgranular to intergranular in the temperature range corresponding to the localized temperatures occurring in the cutting zone during machining.

Another object of the invention is to provide enhanced machinability in free-machining steels without the need to rely on the formation of a soft phase surrounding sulfide inclusions, such as a low melting metal like lead or bismuth or a plastic oxide, such as a complex oxide containing calcium, to improve machinability in free-machining steel.

Another object of the invention is to provide a free-machining steel in which machinability-enhancing embrittlement can be controllably induced into the steel prior to machining and then be controllably removed from the steel after machining.

Another object of the invention is to provide a free-machining steel from which it is possible to remove, after machining, the embrittlement in the 200° C. to 600° C. temperature range suffered by lead-bearing free-machining steels.

Another object of the invention is to provide a free-machining steel which does not have the problems of lead-bearing free-machining steels associated with the disposal of machining chips containing lead.

Another object of the invention is to provide a free-machining steel which utilizes tin to improve machinability.

Another object of the invention is to provide a free-machining steel utilizing tin to improve machinability in which the bulk tin content of the steel has been minimized so as to avoid the deleterious effects, such as hot tearing, that occur with higher bulk tin contents.

Another object of the invention is to provide a free-machining steel in which it is possible to controllably enhance machinability using a small bulk tin content by reversibly concentrating tin at ferrite grain boundaries of the steel.

Another object of the present invention is to provide a free-machining steel which can be machined into parts which are useful as machined steel parts.

Another object of the invention is to provide processes of making free-machining steels which accomplish the foregoing objects. A further object of this invention is to provide products obtained from those processes.

The present invention accomplishes the foregoing objects by providing free-machining steels which use a concentration of tin at ferrite grain boundaries in conjunction with manganese sulfide inclusions in the steel to provide machinability comparable to, or better than, that obtained with conventional lead-bearing free-machining steels, and by providing processes for making such steels.

The present invention encompasses a free-machining steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, and tin from about 0.04 to about 0.08, the balance consisting essentially of iron and incidental impurities, wherein a ratio of the manganese content to the sulfur content is from about 2.9 to about 3.4 and a total of the sulfur plus the tin plus the copper is no more than about 0.9 weight percent, the composition being characterized by a microstructure having a concentration of tin at ferrite grain boundaries in an amount of at least about ten times the bulk tin content of the steel.

The present invention also encompasses processes for preparing free-machining steels comprising the steps of providing a steel having tin as a constituent, precipitating manganese sulfide inclusions in the steel, developing ferrite grain boundaries in the steel, and concentrating the tin at the ferrite grain boundaries. The present invention also encompasses processes further comprising steps of machining the steel and of controllably redistributing the tin more homogeneously throughout the steel. The latter step controllably removes the machinability-enhancing embrittlemcnt resulting from the tin concentration at ferrite grain boundaries of the steel.

The present invention also includes free-machining steels which result as products of employing the processes embraced by the present invention.

The present invention also contemplates the use of concentrations of arsenic and antimony at ferrite grain boundaries to promote the machinability of free-machining steels. Thus, the present invention also includes the above-described tin-bearing compositions, processes, and free-machining steels in combination with substitutions being made therein for tin, in whole or in part, by either antimony or arsenic, either alone or in combination with each other, for the purpose of providing the steel with good machinability. Where antimony is used in the present invention, the bulk content of antimony is in the range of about 0.015 to about 0.055 weight percent. Where arsenic is used in the present invention, the bulk content of arsenic is in the range of about 0.03 to about 0.13 weight percent. The sum of the bulk contents in weight percent of the tin plus arsenic plus antimony plus sulphur plus copper should be no more than about 0.9 weight percent. The term "machinability enhancing agent" or "MEA" is used herein to refer to tin, arsenic, and antimony, either alone or in combination with each other.

These and other features, aspects and advantages of the present invention will become better understood with reference to the following definitions, descriptions of preferred embodiments, examples, appended claims, and accompanying drawings.

DEFINITIONS

1. Bulk Content

Similarly, as used herein the phrase "bulk content," and syntactic inflections of that phrase, of any element or group of elements refers to the overall amount in weight percent of that element or group of elements present in the steel as would be determined by a chemical analysis of a bulk sample of the steel. For example, "MEA bulk content" or "bulk MEA content" both refer to the amount of MEA in the steel as would be determined by a chemical analysis of a bulk sample of the steel. Likewise, the phrase "bulk tin content" or "tin bulk content" refers to the overall amount of tin present in the steel as would be determined by a chemical analysis of a bulk sample of the steel.

2. C Index

The "C index" is a measurement value used to evaluate the machinability of a steel. The C index value of a steel is determined on the basis of a number of machining tests wherein the cutting speed is varied and the amount of material removal is determined for a fixed amount of cutting tool wear. The C index measurement scale has been selected so that a theoretical reference steel having 200 cubic centimeters of material removal at a cutting surface speed of 100 meters per minute has a C index of 100. Therefore, steels having C index values greater than 100 have greater machinability than the reference steel and those steels having C index values of less than 100 have lower machinability than the reference steel.

Figure 1:
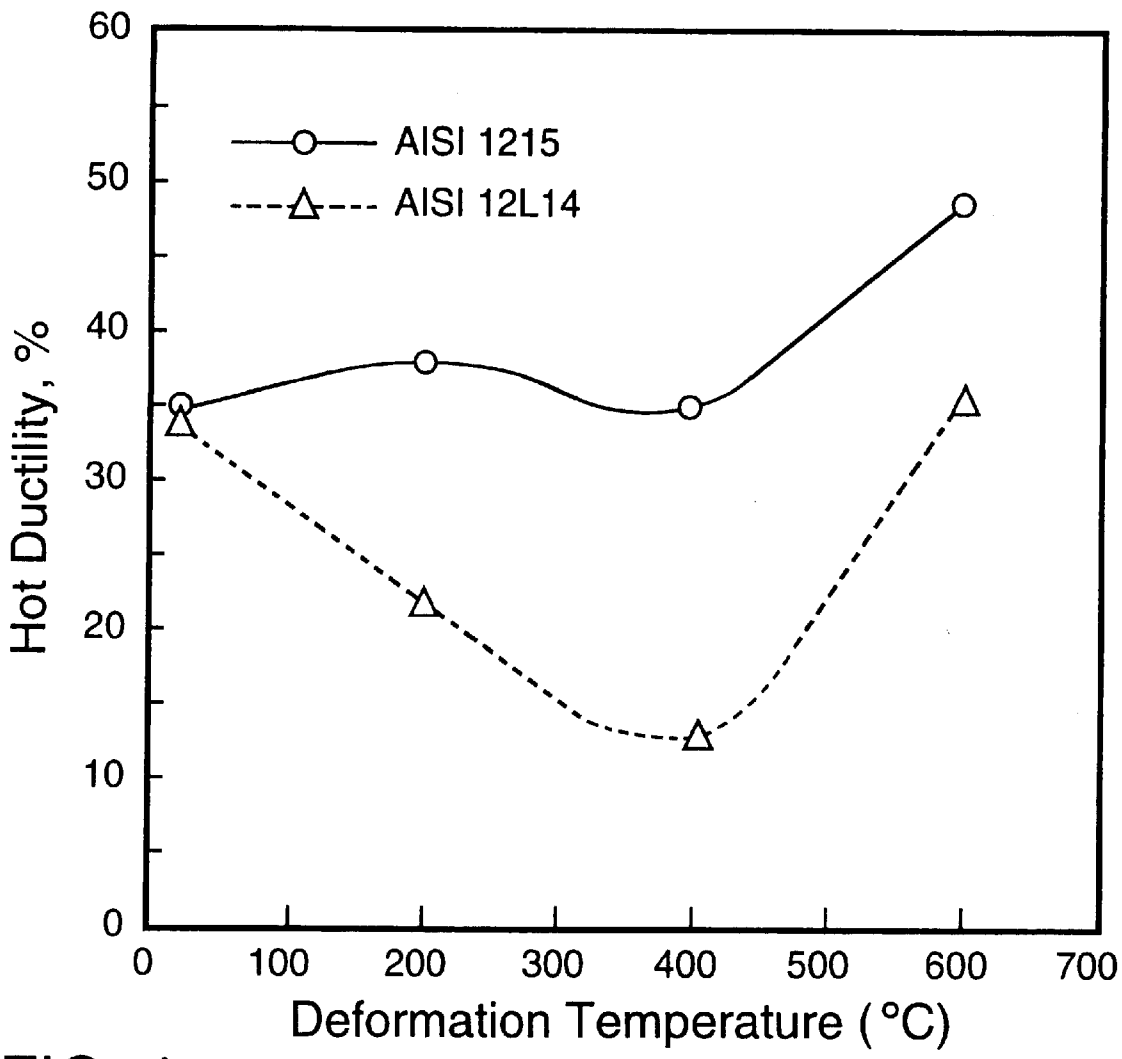
FIG. 1 shows a graph of the results of hot compression tests conducted on conventional free-machining AISI grades 1215 and 12L14 in the temperature range of room temperature to 600° C.
Figure 2:
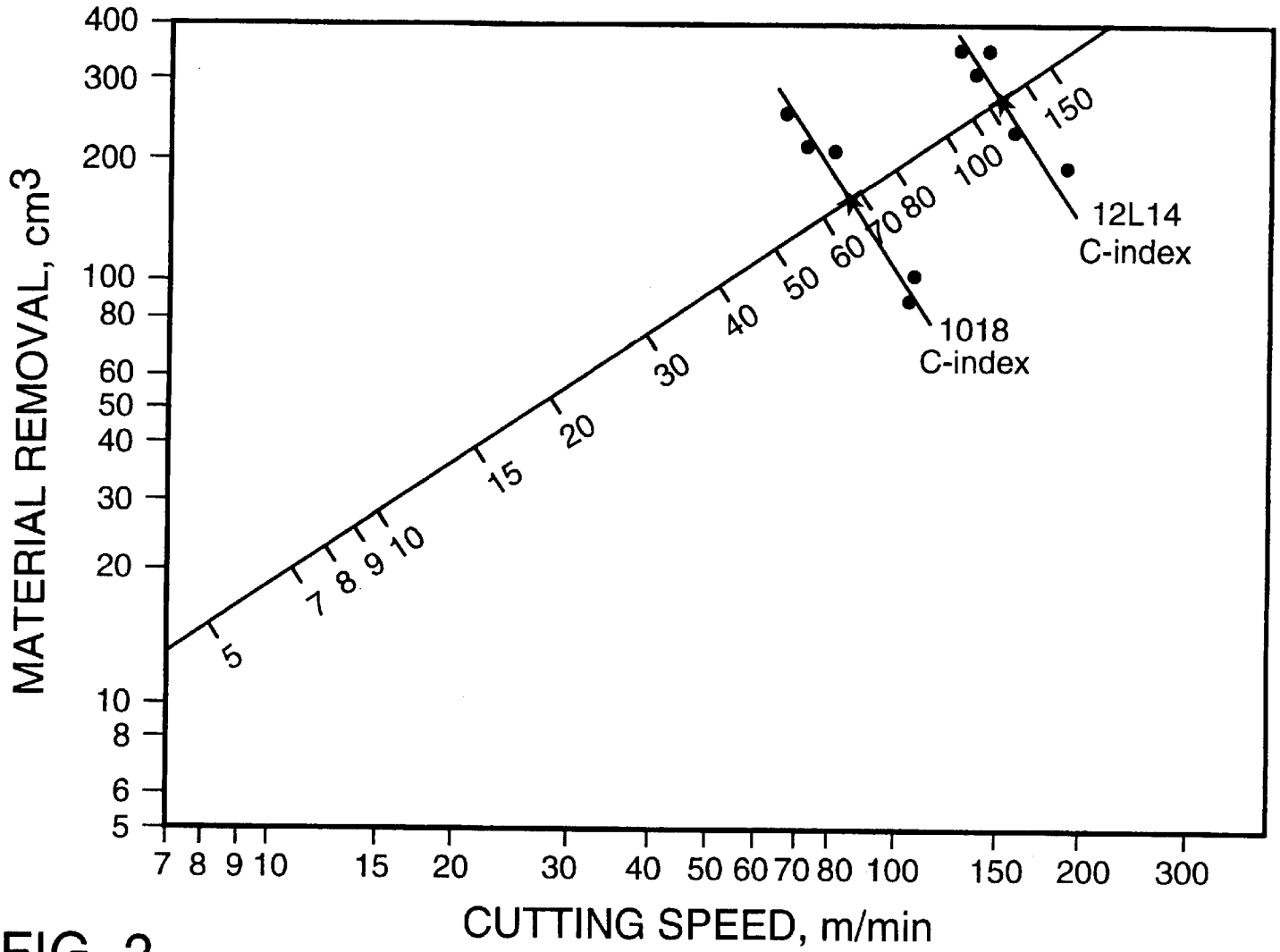
FIG. 2 shows an example of a C-index graph.

The method of measuring the C index value is as follows. For a selected cutting speed, a single-point end-mill using a standard high-speed steel cutting tool, a standard coolant, and a standard feed rate is used to cut the surface of a cylindrical test sample having a diameter of 25.4 millimeters (1 inch). Cutting is continued until the tool piece exhibits 0.7 millimeter of flank wear. The volume of material removed from the test sample is measured. The test is then repeated using other cutting speeds. The results of the tests are plotted on a log-log graph with the material volume removed plotted on the ordinate and the cutting speed plotted on the abscissa, as is shown in FIG. 2. The graph contains a reference line which is logarithmically graduated with C index values. A best-fit line is drawn through the plotted test points and, if necessary, is extended, to cross the reference line. The intersection of this best-fit line drawn through the test points with the reference line gives the C index value for the test material.

The testing conditions used for determining C index values are described in greater detail in "The Volvo Standard Machinability Test," Std. 1018.712, The Volvo Laboratory for Manufacturing Research, Trollhattan, Sweden, 1989, which is incorporated herein by reference. However, that publication describes the measurement of what is referred to therein as a "B index." The only difference between the B index and the C index testing methods is the diameter of the test sample: the C index uses a 25.4 millimeter (1 inch) diameter test sample whereas the B index uses a 50 millimeter diameter test sample. The B index graph given in the cited publication is used to determine the C index when the C index test sample size is used.

3. Concentration of Tin at Ferrite Grain Boundaries

The phrase "concentration of tin at ferrite grain boundaries," and syntactic inflections of that phrase, refer to the amount of tin that is located at the ferrite grain boundaries of the steel as measured by the technique described in the following paragraphs. It is critical to the understanding of the present invention to distinguish between the bulk tin content of the steel and the concentration of tin at ferrite grain boundaries.

The concentration of tin at ferrite grain boundaries is measured in the following manner. A sample of the steel is electropolished into needle specimens using a solution of 25% perchloric acid in acetic acid floating upon carbon tetrachloride and a voltage of 15–20 volts DC. As the electropolishing progresses, the steel sample necks down at the interface between these two immiscible liquids until it finally breaks into two needle pieces. One of the needles is then sharpened by electropolishing using 2% perchloric acid in 2-butoxyethanol and a voltage of 10–15 volts DC. The needle is then examined with a transmission electron microscope to determine if a ferrite grain boundary is within 300 nanometers of the needle tip. If no ferrite grain boundary is within 300 nanometers of the end of the needle tip, then the needle sample is micro-electropolished using 2% perchloric acid in 2-butoxyethanol and a voltage of 10 volts DC, with the voltage being supplied by a pulse generator for which the time interval can be controlled on the order of milliseconds. The needle tip is again examined with transmission electron microscope. The cycle of micro-electropolishing and transmission electron microscope examination is continued until a ferrite grain boundary is within 300 nanometers of the end of the needle tip. The ferrite grain boundary is then examined in an Atom Probe Field Ion Microscope whereby a raw value of the concentration of the tin, $C_R$, is measured. This raw value, $C_R$, is then multiplied by a correction factor, K, to obtain a corrected value of the concentration of tin at ferrite grain boundaries, $C_C$. The correction factor, K, is the ratio of the observed ferrite grain boundary area to the aperture area of the Atom Probe Field Ion Microscope. That is, K is equal to the observed area of the ferrite grain boundary divided by the area of the field of observation of the Atom Probe Field Ion Microscope. Thus, $$K=A_{gb}/A_a=(l\times t)/(\pi\times r^2)$$

and $$C_C=K\times C_R$$

where,

K is the correction factor;

$A_{gb}$ is the observed area of the ferrite grain boundary visible in the field of observation;

$A_a$ is the area of the aperture of the Atom Probe Field Ion Microscope, that is, the area of the field of observation;

l is the length of the ferrite grain boundary visible in the field of observation;

t is the width of the ferrite grain boundary visible in the field of observation;

r is the radius of the field of observation;

$C_C$ is the corrected tin concentration at ferrite grain boundaries; and $C_R$ is the raw value of the tin concentration, within the area of the aperture that contains the ferrite grain boundary, measured by the Atom Probe Field Ion Microscope.

The above steps are repeated until a corrected value, $C_C$, is obtained for each of four to six ferrite grain boundaries of the steel. An average is then taken of all the corrected values thus obtained to determine the average tin concentration at the ferrite grain boundaries of the steel. It is this average value that is referred to herein as the "concentration of tin at ferrite grain boundaries."

4. Concentrate the Tin at the Ferrite Grain Boundaries

The phrase "concentrate the tin at the ferrite grain boundaries," and syntactic inflections of that phrase, refer to subjecting a tin-bearing steel to thermodynamic and kinetic conditions which result in tin atoms becoming resident at the ferrite grain boundaries of the steel in significant numbers such that the amount of tin at the ferrite grain boundaries exceeds the bulk tin content in the steel. In other words, a step which concentrates the tin at the ferrite grain boundaries results in a concentration of tin at the ferrite grain boundaries that, as measured by the measurement technique described above, exceeds the bulk tin content in the steel.

5. Equivalent Diameter

The concept of an "equivalent diameter" is employed to correlate heating or cooling times, temperatures, or rates for acquiring a particular metallurgical condition, as determined for a cylindrical sample of a metal, to a non-cylindrical sample of that metal. The phrase "equivalent diameter" refers to the diameter that would be possessed by a cylindrical sample, of the same metal as the non-cylindrical metal sample under consideration, that would acquire the same metallurgical condition as the non-cylindrical sample when subjected to the same heating or cooling conditions. Thus, the equivalent diameter of a given piece of steel would be the diameter had by the cylindrical sample that would correspond to that piece of steel for the purpose of determining the heating or cooling conditions necessary to arrive at a desired metallurgical condition in that piece of steel.

6. Incidental Impurities

The phrase "incidental impurities" refers to those impurities which are present in the steel as a result of the steelmaking process.

7. Reconcentrating the Tin at the Ferrite Grain Boundaries

The phrase "reconcentrating the tin at the ferrite grain boundaries," and syntactic inflections of that phrase, refer to subjecting the steel, after the steel has been subjected to a process of redistributing the tin in the steel, to thermodynamic and kinetic conditions, which are conducive to concentrating the tin at the ferrite grain boundaries of the steel, for a sufficiently long time for the concentration of the tin at the ferrite grain boundaries to increase.

8. Redistributing the Tin in the Steel

The phrase "redistributing the tin in the steel," and syntactic inflections of that phrase, refer to subjecting the steel to thermodynamic and kinetic conditions, which are conducive to homogenizing the tin distribution in the steel, for a sufficiently long time for the concentration of the tin at the ferrite grain boundaries to diminish and then cooling the steel at a rate sufficiently fast to prevent the tin from reconcentrating at the ferrite grain boundaries of the steel.

9. Type I Manganese Sulfide Inclusions

The phrase "Type I manganese sulfide inclusions" refers to manganese sulfide inclusions in the steel which have a globular shape and are formed when the oxygen content is about 0.01 weight percent or greater. The globular shape of the manganese sulfide inclusions is to be determined when the steel is in the as-solidified condition, that is, before the steel is subjected to deformation processes which may cause some alteration of the shape of the manganese sulfide inclusions.

10. Type II Manganese Sulfide Inclusions

The phrase "Type II manganese sulfide inclusions" refers to manganese sulfide inclusions in the steel which have a rod-like shape and are formed when the oxygen content is between about 0.003 and about 0.01 weight percent. The rod-like shape of the manganese sulfide inclusions is to be determined when the steel is in the as-solidified condition, that is, before the steel is subjected to deformation processes which may cause some alteration of the shape of the manganese sulfide inclusions.

11. Machinability Enhancing Agent or MEA

The term "machinability enhancing agent" or "MEA" is used herein to refer to tin, arsenic, and antimony, either alone or in combination with each other.

DETAILED DESCRIPTION OF PREFERRED EMBODIMENTS

Preferred embodiments of the present invention include free-machining steels which use a concentration of tin at ferrite grain boundaries of the steel in conjunction with a dispersion of manganese sulfide inclusions to provide machinability comparable to, or better than, that obtained with conventional, lead-bearing, free-machining steels. Such embodiments have compositions in which certain elements are controlled within specified ranges and the ratios of the content of some interrelated elements are also controlled. It is to be understood that where a range is described herein, the inventors contemplate that every increment between the endpoints of the range is to be understood to be included as part of the invention.

A preferred embodiment of the present invention consists of a free-machining steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, tin from about 0.04 to about 0.08, with a balance of iron and incidental impurities, wherein a ratio of the manganese to the sulfur is from about 2.9 to about 3.4 and a total of the sulfur plus the tin plus the copper is no more than about 0.9 weight percent, the composition being characterized by a microstructure having a concentration of tin at ferrite grain boundaries in an amount of at least about ten times the bulk tin content of the steel.

In a more preferred embodiment of the present invention, the composition of the free-machining steel consists essentially of, in weight percent, carbon from about 0.01 to about 0.25, copper up to about 0.5, manganese from about 0.5 to about 1.5, oxygen from about 0.003 to about 0.03, sulfur from about 0.2 to about 0.45, and tin from about 0.04 to about 0.08, with a balance of iron and incidental impurities wherein a ratio of the manganese to the sulfur is from about 2.9 to about 3.4 and a total of the sulfur plus the tin plus the copper is no more than about 0.9 weight percent, the composition being characterized by a microstructure having a concentration of tin at ferrite grain boundaries in an amount of at least about ten times the bulk tin content of the steel.

In a still more preferred embodiment of the present invention, the composition of the free-machining steel consists essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, tin from about 0.04 to about 0.08, with a balance of iron and incidental impurities, wherein a ratio of the manganese to the sulfur is from about 2.9 to about 3.4 and a total of the sulfur plus the tin plus the copper is no more than about 0.9 weight percent, the composition being characterized by a microstructure having a concentration of tin at ferrite grain boundaries in an amount of at least about ten times the bulk tin content of the steel.

The composition of each preferred embodiment of the present invention is characterized by a microstructure having a concentration of tin at ferrite grain boundaries. Preferably, the concentration of tin at the ferrite grain boundaries of the steel is at least ten times the bulk tin content. More preferably, the concentration of tin at the ferrite grain boundaries is at least 0.5 weight percent.

The preferred embodiments of the present invention enhance machinability by utilizing a concentration of tin at the ferrite grain boundaries in conjunction with manganese sulfide particles dispersed throughout the steel. The type of manganese sulfide inclusions in these preferred embodiments are preferably Type I manganese sulfide inclusions or Type II manganese sulfide inclusions or a combination of Type I manganese sulfide inclusions and Type II manganese sulfide inclusions.

The importance of the specific elemental ranges in these preferred embodiments is described below in more detail. Unless otherwise stated, the contents given are the bulk contents of the elements in the steel.

The tin content in these embodiments is preferably in the range of about 0.04 to about 0.08 weight percent. Below this range, the amount of machinability-enhancement obtained from concentrating the tin at ferrite grain boundaries decreases. Above this range, the steel becomes more susceptible to hot tearing during hot working. More preferably, the tin content is in the range of from 0.04 to about 0.06 weight percent. Furthermore, when the combined total of the contents of tin, sulfur, and copper, in weight percent, exceeds about 0.9 weight percent, the susceptibility of the steel to hot tearing is increased. Thus, it is preferred that, in these preferred embodiments of the present invention, the total of tin, sulfur, and copper contents, in weight percent, not exceed about 0.9 weight percent.

The manganese content in these preferred embodiments of the present invention is preferably not less than 0.01 weight percent so that a sufficient amount of manganese sulfide inclusions to promote machinability can be precipitated in the steel by precipitation from the melt. Also, it is preferred that the manganese content not exceed about 2 weight percent because increasing the manganese content above 2 weight percent may increase the hardness of the steel thereby decreasing the machinability. In more preferred embodiments of the invention, the manganese content is from about 0.5 to about 1.5 weight percent.

The sulfur content in these preferred embodiments of the present invention is preferably not less than about 0.002 weight percent so that a sufficient amount of manganese sulfide inclusions to promote machinability can be precipitated in the steel by precipitation from the melt. Because excess sulfur can form iron sulfide, which can cause hot tearing of the steel, it is also preferred that the sulfur content not exceed about 0.8 weight percent. In more preferred embodiments of the invention, the sulfur content is from about 0.2 to about 0.45 weight percent.

Inasmuch as some fraction of the manganese and sulfur combine to form manganese sulfide inclusions, which contribute to the machinability, it is desirable in these preferred embodiments of the present invention to control the ratio of the manganese content to the sulfur content from about 2.9 to about 3.4. Confining the ratio of manganese content to sulfur content to this range of ratios also helps to prevent the element that is excess from causing undesirable effects. When the ratio is less than about 2.9, the manganese content may be insufficient to combine with sulfur to provide the desired manganese sulfide inclusions, and the excess sulfur may form iron sulfide, which can make the steel susceptible to cracking during hot working. When the ratio is greater than about 3.4, the excess manganese may increase the hardness of the steel, thereby decreasing the machinability of the steel.

The oxygen content in these preferred embodiments of the present invention is preferably in the range of from about 0.003 to about 0.03 weight percent. Maintaining the oxygen in this range helps to minimize the amount of abrasive oxide inclusions present in the steel. Maintaining the oxygen in this range also helps to insure that the manganese sulfide inclusions are of types which promote machinability. That is, when the oxygen content is maintained within this range, the manganese sulfide inclusions precipitated are more likely to be Type I manganese sulfide inclusions, Type II manganese sulfide inclusions, or a combination of Type I and Type II manganese sulfide inclusions.

All steels contain some carbon. In preferred embodiments of the present invention, it is desirable that the carbon content is up to about 0.25 weight percent, so as to optimize the ferrite content of the steel and thereby promote machinability. More preferably, the carbon content in the preferred embodiments is from about 0.01 to about 0.25 weight percent.

Copper can reduce the ductility of steel. Therefore, it is preferred in some embodiments of the present invention that the copper content be no greater than about 0.5 weight percent.

Phosphorus is often added to free-machining steels to improve the smoothness of the machined surface. However, excessive amounts of phosphorus may reduce the ductility of the steel. Therefore, it is desirable in some embodiments of the present invention that the phosphorus content be in the range from about 0.01 to about 0.15 weight percent.

Nitrogen is known to promote chip breakability. However, nitrogen may react with other elements to form hard nitrides or carbonitrides that can increase tool wear thereby decreasing machinability. Therefore, in some preferred embodiments of the present invention, it is preferred that the nitrogen content be no greater than about 0.015 weight percent.

Silicon may form abrasive oxide inclusions which can be detrimental to cutting tool life. Therefore, it is preferable that the silicon content be kept as low as possible, and, in some preferred embodiments of the present invention, more preferably be limited to no more than about 0.05 weight percent.

Aluminum also may form abrasive oxide particles which can be detrimental to cutting tool life. Therefore, it is preferable that the aluminum content be kept as low as possible, and, in some preferred embodiments of the present invention, more preferably be limited to no more than about 0.005 weight percent.

Some preferred versions of a process for preparing free-machining steels in accordance with the present invention comprise the steps of providing a steel having tin as a constituent, precipitating manganese sulfide inclusions in the steel, developing ferrite grain boundaries in the steel, and concentrating the tin at the ferrite grain boundaries. Though in different embodiments of the present invention these steps may be accomplished in a variety of ways, a number of preferred ways of accomplishing these steps will now be discussed.

The step of providing a steel having tin as a constituent is preferably accomplished by producing, by conventional steelmaking methods, a molten steel having a composition which includes tin. Preferably the steel provided will have a composition described above for preferred embodiments of the present invention. This step is important as it sets the stage for the remaining steps of the process.

The step of precipitating manganese sulfide inclusions in the steel is accomplished by precipitating manganese sulfide inclusions from the molten steel composition during solidification of the steel. Preferably, this step results in Type I manganese sulfide inclusions or Type II manganese sulfide inclusions or a combination of Type I and Type II manganese sulfide inclusions being dispersed throughout the steel. This step is important because it results in the steel having manganese sulfide inclusions which contribute to the machinability of the steel.

The step of developing the ferrite grain boundaries in the steel is preferably accomplished by cooling the steel from above the steel's austenite transformation temperature, $A_{R3}$, after the steel has been hot worked or heat treated, though it is also within the contemplation of the present invention that the ferrite grain boundaries be developed during cooling from the solidification of the steel. This step is important because it results in the formation of the ferrite grain boundaries which, when weakened by a concentration of tin at the localized machining temperatures, will participate in the intergranular fracture by which the machinability of the steel is enhanced. In order to accomplish this step, it is necessary that the cooling rate employed from the austenite range of the steel be not so fast that the formation of ferrite is avoided. Preferably, a cooling rate from the austenite range will be chosen so that the microstructure of the steel, after cooling, will contain at least about 80 volume percent ferrite with the balance consisting of pearlite.

The step of concentrating the tin at the ferrite grain boundaries is important because it places sufficient quantities of tin in that portion of the microstructure from which the tin can effectuate an enhancement of machinability by causing intergranular fracture to occur at the localized machining temperatures in a manner like that which the inventors have discovered lead does in lead-bearing free-machining steels. This step may be accomplished in a number of ways Two of the preferred ways of accomplishing this step will now be described.

One preferred way of concentrating the tin at the ferrite grain boundaries is to cool the steel at a cooling rate slower than about 1° C. per second through the temperature range of from about 700° C. to about 400° C. More preferably, the cooling rate through this cooling range is about 28° C. per hour, a cooling rate that attends a common coiling practice for bar steel. The cooling may be done following a subjection of the steel to high temperature such as occurs during solidification, heat treating, or hot working operations. Preferably, the cooling is done after some hot working operation on the steel, such as hot rolling or hot forging, has been completed at temperatures above about 900° C., and more preferably when the finish temperature is in the range of from about 900° C. and about 950° C. Under such circumstances, a preferred way of accomplishing the cooling is to cool the steel under insulation blankets or covers.

Another preferred way of concentrating the tin at the ferrite grain boundaries is to hold the steel in the temperature range of from about 425° C. to about 575° C. for a time sufficiently long to concentrate the tin at the ferrite grain boundaries. Preferably, the hold time is at least about 0.4 hours per centimeter (1 hour per inch) of equivalent diameter of the steel. The hold time necessary for a given temperature exposure for a particular steel article can be determined by analyzing the amount of tin at the ferrite grain boundaries in the manner specified above to determine whether the time was sufficiently long to concentrate the tin at the ferrite grain boundaries. Alternatively, whether or not the hold time was sufficiently long for a given temperature exposure can be ascertained by determining if the machinability has reached the level expected for that steel.

What the described preferred ways of accomplishing the step of concentrating the tin at the ferrite grain boundaries have in common is that they all subject the steel to thermodynamic and kinetic conditions which result in tin atoms becoming resident at the ferrite grain boundaries in significant numbers so that the concentration of tin at ferrite grain boundaries exceeds the bulk tin content. In general, within the above specified temperature ranges, the amount tin concentrated at the ferrite grain boundaries will asymptotically increase as exposure times increase. Thus, in the preferred versions of the present invention described above, the tin concentration at the ferrite grain boundaries will asymptotically increase as the cooling rate through the temperature range of from about 700° C. to about 400° C. is decreased or as the hold time in the temperature range of from about 425° C. to about 575° C. is increased. Thus, it is possible to control the amount of concentration of the tin at ferrite grain boundaries by controlling the amount of time the steel is exposed to these temperature ranges.

Preferably, the step of concentrating the tin at the ferrite grain boundaries results in concentrating the tin at the ferrite grain boundaries to a concentration which is at least about ten times the bulk tin content. More preferably, the step results in concentrating the tin at the ferrite grain boundaries to a concentration of at least about 0.5 weight percent.

Other preferred versions of a process for preparing free-machining steels in accordance with the present invention further comprise the steps of machining the steel and then redistributing the tin in the steel, in addition to the above mentioned steps of providing a steel having tin as a constituent, precipitating manganese sulfide inclusions in the steel, developing ferrite grain boundaries in the steel, and concentrating the tin at the ferrite grain boundaries. Although in different embodiments of the present invention these steps may be accomplished in a variety of ways, a number of preferred ways of accomplishing some of these steps will now be discussed.

The step of machining may be accomplished by any means of machining steel known to those skilled in the art. These means include, but are not limited to, such machining operations as turning, forming, milling, drilling, reaming, boring, shaving, and threading. It is not necessary that all of the machining that is to be done to the steel be accomplished during this machining step. For example, additional machining may be conducted on the steel after the tin redistribution step has produced a partial or complete redistribution of the tin in the steel.

The step of redistributing the tin in the steel comprises subjecting the steel to thermodynamic and kinetic conditions, which are conducive to homogenizing the tin distribution in the steel, for a sufficiently long time for the concentration of the tin at the ferrite grain boundaries to diminish or the ferrite grain boundaries are eliminated and then cooling the steel at a rate sufficiently fast to prevent the tin from reconcentrating at the ferrite grain boundaries. The purpose of this step is to controllably eliminate, either partially or completely, the machinability-enhancing embrittlement in the temperature range of about 200° C. to about 600° C. which resulted from concentrating the tin at the ferrite grain boundaries. Optimally, the thermodynamic and kinetic conditions are maintained until the concentration of the tin at the ferrite grain boundaries is substantially the same as the bulk tin content. This optimal way of practicing this step results in the most thorough removal of the machinability-enhancing embrittlement, and, consequentially, in the most complete restoration of the ductility and/or toughness of the steel in the temperature range of about 200° C. to about 600° C. However, it is not necessary for the practice of those versions of the present invention in which the step of redistributing the tin is employed that the redistribution of the tin be taken to this optimal condition. For example, under circumstances when some improvement in ductility is desired for the service application of the steel but some additional machining operations are anticipated after the tin redistribution step, it may be beneficial to controllably redistribute the tin only partially so as to retain a portion of the machinability-enhancement while regaining the ductility necessary for the steel to perform properly in service.

A preferred way of accomplishing the step of redistributing the tin in the steel is to heat the steel to a temperature above the steel's austenite transformation temperature, $A_{C3}$, for at least 0.4 hours per centimeter (1 hour per inch) of equivalent diameter of the steel and then to cool the steel at a rate faster than 1° C. per second through the temperature range of about 700° C. to about 400° C. This cooling rate avoids a reconcentration of the tin at the ferrite grain boundaries.

The various thermal practices referred to in the above discussion may be conducted by any means known to those skilled in the art. For example, all or part of such thermal practices may be conducted in refractory-lined, temperature-controlled furnaces which are heated electrically or through the combustion of a fuel. The cooling rates discussed may be accomplished in any manner known to those skilled in the art by which cooling temperatures and times can be controlled. For example, the cooling rates maybe achieved by use of furnace cooling or by surrounding the hot steel with insulation materials during cooling. In some preferred versions of the process of the present invention, insulation blankets are placed over the steel at the conclusion of the hot rolling or hot forging process to control the cooling rate.

The present invention also contemplates the use of concentrations of arsenic and antimony at ferrite grain boundaries to promote the machinability of free-machining steels. Therefore, embodiments of the present invention also include the above-described embodiments of tin-bearing compositions, processes, and free-machining steels in combination with substitutions being made therein for tin, in whole or in part, by either antimony or arsenic, either alone or in combination with each other, for the purpose of providing the steel with good machinability. Where antimony is used in embodiments of the present invention, the bulk content of antimony is in the range of about 0.015 to about 0.055 weight percent. Where arsenic is used in embodiments of the present invention, the bulk content of arsenic is in the range of about 0.03 to about 0.13 weight percent. However, the sum of the bulk contents in weight percent of the tin plus arsenic plus antimony plus sulphur plus copper should be no more than about 0.9 weight percent so that problems with hot tearing may be avoided.

EXAMPLES

The following nonlimiting examples are given for illustration but in no way are meant to limit the scope of the present invention.

Example 1

Embodiments of the present invention having different compositions were made were made by vacuum induction melting using standard steelmaking practices. The nominal compositions of these embodiments appear in Table 1.

TABLE 1

| Element* | Sn60 | Sn60M | Sn80 | Sn80M | 12L14 | 1215 | 1018 |
|---|---|---|---|---|---|---|---|
| carbon | 0.08 | 0.08 | 0.08 | 0.08 | 0.15 max | 0.09 max. | 0.15–0.20 |
| manganese | 1.00 | 1.00 | 1.00 | 1.00 | .058–1.15 | 0.75–1.05 | 0.60–0.90 |
| phosphorus | 0.06 | 0.06 | 0.06 | 0.06 | 0.04–0.09 | 0.04–0.09 | 0.040 max |
| sulfur | 0.34 | 0.34 | 0.34 | 0.34 | 0.26–0.35 | 0.26–0.35 | 0.050 max |
| silicon | 0.010 | 0.010 | 0.010 | 0.010 | — | — | — |
| tin | 0.06 | 0.06 | 0.08 | 0.06 | — | — | — |

TABLE 1-continued

| Element* | Sn60 | Sn60M | Sn80 | Sn80M | 12L14 | 1215 | 1018 |
|---|---|---|---|---|---|---|---|
| aluminum | 0.001 | 0.001 | 0.001 | 0.001 | — | — | — |
| nitrogen | 0.005 | 0.005 | 0.005 | 0.005 | — | — | — |
| oxygen | 0.005 | 0.005 | 0.005 | 0.005 | — | — | — |
| copper | 0.45 | 0.005 | 0.45 | 0.20 | — | — | — |
| lead | — | — | — | — | 0.25 | — | — |
| Comments | embodiment of present invention | embodiment of present invention | embodiment of present invention | embodiment of present invention | conv. lead-bearing free-mach. steel | conv. free-mach. steel (no lead) | conv. steel (non-free-mach.) |

*All compositions are nominal and are given in weight percent.

In making these embodiments, the raw materials were charged into the melting furnace in two stages. First, a base charge consisting of graphite, ferrophosporous (containing 25% phosphorus), iron sulfide (containing 50% sulfur), pure copper, and electrolytic iron was charged into the furnace and melted. After the base charge was melted, the remaining elements were added in the following order: electrolytic manganese, pure silicon, and pure tin. The molten steel was poured into 22.4 kilogram (50 pound) ingot molds. The solidified ingots were heated to about 1232° C. (2250° F.) for about 2.5 hours and then hot rolled between about 1232° C. (2250° F.) and about 954° C. (1750° F.) into round bar with a final diameter of about 29 millimeters (1⅛ inches) in ten passes. The bars were then cooled at a rate of about 28° C. per hour (50° F. per hour) to room temperature.

Test samples, each approximately 152 millimeters (6 inches) long by 25.4 millimeters (1 inch) diameter, were prepared from each heat. Comparison samples of hot rolled AISI grades 1018, 1215, and 12L14, which were obtained from commercial sources, were also machined to the test sample size. AISI grade 1018 is a low carbon steel which is not considered to be free-machining. AISI grade 1215 is a conventional, unleaded, free-machining steel. AISI grade 12L14 is a conventional lead-bearing free-machining steel. The nominal compositions of these three commercial grades is given in Table 1.

The C index values, as defined above, of each of the samples was determined. The C index values are reported in Table 2.

TABLE 2

| Grade | Machinability © Index) | Remarks |
|---|---|---|
| 1215 | 90–127 | Conventional, unleaded, free-machining steel |
| 12L14 | 121–125 | Conventional, lead-bearing, free-machining steel |
| 1018 | 66 | Conventional, non-free-machining steel |
| Sn60 | 127 | Embodiment of present invention |
| Sn60M | 142 | Embodiment of present invention |
| Sn80 | 126 | Embodiment of present invention |
| Sn80M | 135 | Embodiment of present invention |

The test results clearly show that the machinability of the tested embodiments of the present invention match or exceed that of the conventional free-machining steels tested. The results also show that the machinability of some of the tested embodiments of the present invention greatly exceeds the machinability of the conventional, lead-bearing, free-machining steel tested. The results also demonstrate that the tested embodiments of the present invention greatly exceed the machinability of the tested conventional non-free-machining steel AISI grade 1018.

Example 2

Experiments were conducted to determine the effect of thermal practice on the machinability of some embodiments of the present invention. A comparison sample which had a composition of the present invention except that it did not have tin concentrated at the ferrite grain boundaries was also tested.

The samples were prepared as described in Example 1, except that the thermal practice of the samples was varied. The hot rolling finish temperature of the Sn60M and Sn80M samples was about 954° C. (1750° F.). Some of these samples were slow cooled from the hot rolling finish temperature at about 28° C. per hour to room temperature, simulating a cooling rate used with commercial bar coiling operations. Other samples were cooled from the hot rolling temperature to room temperature at a rate of about 1° C. per second. Still other samples, after being cooled from the hot rolling temperature to room temperature at a rate of about 1° C. per second, were subsequently heated to about 500° C. for about two hours and then air cooled to room temperature.

The Sn60 samples were hot rolled with a finish temperature of about 900° C. (1650° F.) and then air cooled at about 5° C. per second to room temperature. This fast cooling rate did not permit the tin to concentrate at the ferrite grain boundaries. One of these samples was tested in the as-cooled condition and used as the comparison sample. The other Sn60 sample was heated to about 450° C. (842° F.) for about one hour to concentrate tin at the ferrite grain boundaries according to the present invention and then air cooled to room temperature before being tested.

Measurements of C index values were made on each sample. The results are presented in Table 3.

TABLE 3

| Grade | Thermal practice* | Machinability © Index) |
|---|---|---|
| Sn60 | HR + Cool to RT at 5° C./second | 110 |
| | HR + Cool to RT at 5° C./second + 450° C. for 1 hour + air cool to RT | 122 |
| Sn60M | HR + Cool to RT at 28° C./hour | 142 |
| | HR + Cool to RT at 1° C./second | 136 |
| | HR + Cool to RT at 1° C./second + 500° C. for 2 hours + Air cool to RT | 143 |

TABLE 3-continued

| Grade | Thermal practice* | Machinability © Index) |
|---|---|---|
| Sn80M | HR + Cool to RT at 28° C./hour | 135 |
| | HR + Cool to RT at 1° C./second | 129 |
| | HR + Cool to RT at 1° C./second + 500° C. for 2 hours + Air cool to RT | 135 |

*"HR" means "hot rolled" under the conditions described in Example 1; "RT" means "room temperature."

The results show that each of the tested embodiments of the present invention displayed excellent machinability in all of the thermal practice conditions tested. In contrast, the comparison sample of Sn60 which did not have the tin concentrated at the ferrite grain boundaries displayed markedly poorer machinability.

The results also show that the samples cooled at about 28° C. per hour and the samples subjected to the 500° C. hold had better machinability than did the samples cooled at 1° C. per second. This indicates that the machinability can be controlled by controlling the time the steel is subjected to thermodynamic and kinetic conditions conducive to concentrating the tin at the ferrite grain boundaries. Thus, the results show that longer exposure to the temperature ranges at which tin is concentrated at the ferrite grain boundaries results in higher concentrations of tin at the ferrite grain boundaries and in better machinability in the steel.

Example 3

A test was conducted in a high volume, complex production machining environment. In the test, an embodiment of the present invention, Sn80, was compared with traditional 12L14 leaded steel. The machine used was the high volume Hydromat model HB 32/45 sixteen station rotary transfer machine which was capable of performing a variety of machining operations. The production rate was approximately 300 parts per hour. The machining of each part consisted of the following machining operations: 1) cut-off, 2) rough turning, 3) finish turning, 4) chamfer, 5) facing, 6) drilling, 7) reaming, 8) rough boring, 9) final boring, 10) counter boring, 11) deburring, and 12) burnishing. The tools used were 1) high speed steel, 2) titanium nitride coated carbide, 3) uncoated carbide, 4) steam temper saw, and 5) a 52100 equivalent burnishing tool. The results are reported in Table 4.

TABLE 4

| Parameter | Sn80 | 12L14 |
|---|---|---|
| Chip characteristics | Short and hard; breaks easily; easily disposed. | Short and hard; breaks easily; easily disposed. |
| Chip suitability | Desirable | Desirable |
| Machine operator judgment of operation process | Excellent | Excellent |
| Machine operator judgment of finished cut | Smooth to the touch | Smooth to the touch |
| Surface roughness: non-burnished condition. | 0.9 microns (35 microinches) | 1.3 microns (50 microinches) |
| Surface roughness: burnished condition. | 0.10–0.15 microns 4–6 microinches | 0.18–0.20 microns 7–8 microinches |

The results show that the tested embodiment of the present invention performed at least as well as the conventional 12L14 leaded steel and had a smoother surface finish in both the non-burnished and burnished conditions.

Example 4

Hot ductility tests were conducted on an embodiment of the present invention to determine if it would exhibit embrittlement at temperatures corresponding to the localized cutting zone temperatures as does conventional lead-bearing free-machining steel grade 12L14. A conventional, free-machining steel which does not contain lead, AISI grade 1215, was also tested for comparison.

The embodiment of the present invention tested was Sn80. The nominal composition of Sn80 appears in Table 1. Sn80 was prepared in the manner described in Example 1, except that three different thermal practice conditions were used so as to allow a determination of the effect of increasing concentrations of tin at the ferrite grain boundaries on hot ductility. In the first condition, the Sn80 was hot rolled and then cooled at a rate of about 28° C. per hour to room temperature. The remaining two conditions both started with Sn80 in the hot rolled-and-cooled-to-room temperature state of the first condition. In the second condition, the steel was reheated to 500° C. for a hold time of one hour and then air cooled to room temperature. In the third condition, the steel was reheated to 500° C. for a hold time of two hours and then air cooled to room temperature. Due to the progressively longer exposure times of the sample to temperature ranges at which tin concentrates at the ferrite grain boundaries, progressively greater amounts of tin concentrations were expected for the three conditions.

Figure 3:
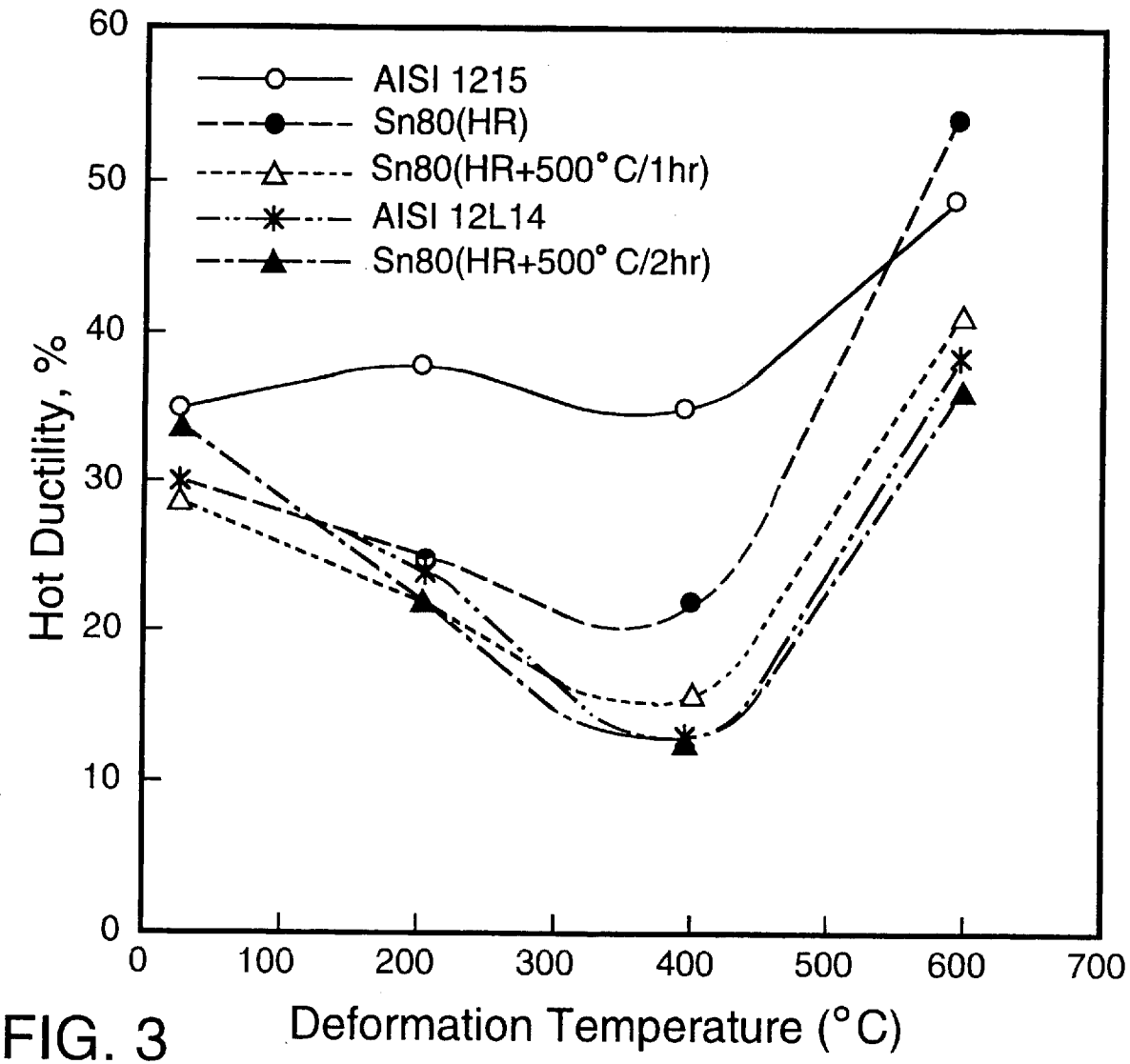
FIG. 3 shows a graph of the results of hot compression tests conducted on embodiments of the present invention compared with the results of similar tests conducted on conventional free-machining steel AISI grades 1215 and 12L14 in the temperature range of room temperature to 600° C.

The hot ductility tests were conducted on flanged compression samples using a strain rate of 20 second$^{-1}$ at temperatures between room temperature and 600° C. The hot ductility was determined by measuring the amount of Hoop strain at which crack initiation occurred on the outer surface of the flange. The results of the tests are displayed graphically in FIG. 3. The results are also reported in Table 5 which reports the loss of ductility at 400° C. from the room temperature ductility level. The loss of ductility at 400° C. represents the depth of the machinability-enhancing embrittlement trough.

The ferrite content of all of the samples tested was about 95 volume percent as determined by microscopic image analysis of polished metallographic specimens.

TABLE 5

| Grade | Condition | Ductility Loss at 400° C. | Remarks |
|---|---|---|---|
| 1215 | hot rolled | 0% | Conventional free-machining steel |
| 12L14 | hot rolled | 19–21% | Conventional, lead-bearing, free-machining steel |
| Sn80 | hot rolled | 8% | Embodiment of present invention |
| | 500° C. for 1 hour | 15% | Embodiment of present invention |
| | 500° C. for 2 hours | 17% | Embodiment of present invention |

The tests show that each tested embodiment of the present invention displayed embrittlement trough behavior similar to that of the conventional, lead-bearing, free-machining steel. The results also show that the trough deepened for the tested embodiments of the present invention as the tin concentration at the ferrite grain boundaries increased. The results also demonstrate that the embrittlement trough was absent in the conventional, free-machining steel which did not contain lead.

Microscopic examination of some of the fracture surfaces of the tested embodiments showed that the fracture mode was transgranular outside of the embrittlement trough region and intergranular inside the embrittlement trough region. The same fracture mode behavior was also observed on the conventional, free-machining steel which contained lead, that is, on the AISI grade 12L14 grade samples. However, the fracture mode was transgranular throughout the tested temperature range for the conventional, free-machining steel which did not contain lead, that is, the AISI grade 1215 sample.

While only a few embodiments and versions of the present invention have been shown and described, it will be obvious to those skilled in the art that many changes and modifications may be made thereunto without departing from the spirit and scope of the present invention. Therefore, it is to be distinctly understood, that the present invention is not limited to the specific embodiments and versions described herein but may be otherwise embodied and practiced within the scope of the following claims.

We claim:

1. A free-machining steel composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent, the composition being characterized by a microstructure having a concentration of the MEA at ferrite grain boundaries in an amount of at least about ten times the bulk MEA content of the steel.

2. The free-machining steel composition as described in claim 1, wherein the concentration of the MEA at the ferrite grain boundaries is at least about 0.5 weight percent.

3. The free-machining steel composition as described in claim 1, wherein the MEA is arsenic from about 0.03 to about 0.13 weight percent.

4. The free-machining steel composition as described in claim 1, wherein the MEA is antimony from about 0.015 to about 0.055 weight percent.

5. A free-machining steel composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent, the composition being characterized by a microstructure having a concentration of the MEA at ferrite grain boundaries in an amount of at least about ten times the bulk MEA content of the steel.

6. The free-machining steel composition as described in claim 3, wherein the concentration of the MEA at the ferrite grain boundaries is at least about 0.5 weight percent.

7. The free-machining steel composition as described in claim 1, wherein the MEA is arsenic from about 0.03 to about 0.13 weight percent.

8. The free-machining steel composition as described in claim 1, wherein the MEA is antimony from about 0.015 to about 0.055 weight percent.

9. A process for preparing a free-machining steel, comprising the steps of:

a) providing a steel having MEA as a constituent;

b) precipitating manganese sulfide inclusions in the steel;

c) developing ferrite grain boundaries in the steel; and d) concentrating the MEA at the ferrite grain boundaries in an amount of at least about ten times the bulk MEA content of the steel;

wherein the MEA is selected from the group consisting of tin, arsenic, antimony, and combinations thereof.

10. The process described in claim 9, wherein the step of precipitating manganese sulfide inclusions in the steel comprises precipitating manganese sulfide inclusions of a type of at least one selected from the group of Type I manganese sulfide inclusions and Type II manganese sulfide inclusions.

11. The process described in claim 9, wherein the step of concentrating the MEA at the ferrite grain boundaries includes concentrating the MEA at the ferrite grain boundaries to a concentration of at least about 0.5 weight percent.

12. The process described in claim 9, wherein the step of concentrating the MEA at the ferrite grain boundaries comprises cooling the steel at a rate slower than about 1° C. per second through a temperature range from about 700° C. to about 400° C. to concentrate the MEA at the ferrite grain boundaries.

13. The process described in claim 9, wherein the step of concentrating the MEA at the ferrite grain boundaries comprises holding the steel in a temperature range of from about 425° C. to about 575° C. for a time sufficiently long to concentrate the MEA at the ferrite grain boundaries.

14. The process described in claim 9, wherein the time of holding the steel in the temperature range of from about 425° C. to about 575° C. is at least about 0.4 hours per centimeter of an equivalent diameter of the steel.

15. The process described in claim 9, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

16. The process described in claim 15 wherein the MEA is arsenic from about 0.03 to about 0.13 weight percent.

17. The process described in claim 15 wherein the MEA is antimony from about 0.015 to about 0.055 weight percent.

18. The process described in claim 10, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

19. The process described in claim 11, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

20. The process described in claim 12, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

21. The process described in claim 13, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

22. The process described in claim 14, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

23. The process described in claim 9, wherein the step of providing a steel having MEA as a constituent comprises providing a steel having a composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

24. The process described in claim 23 wherein the MEA is arsenic from about 0.03 to about 0.13 weight percent.

25. The process described in claim 23 wherein the MEA is antimony from about 0.015 to about 0.055 weight percent.

26. The process described in claim 10, wherein the step of providing a steel having MEA as a constituent comprises providing a steel having a composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

27. The process described in claim 11, wherein the step of providing a steel having MEA as a constituent comprises providing a steel having a composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

28. The process described in claim 12, wherein the step of providing a steel having MEA as a constituent comprises providing a steel having a composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

29. The process described in claim 13, wherein the step of providing a steel having MEA as a constituent comprises providing a steel having a composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

30. The process described in claim 14, wherein the step of providing a steel having MEA as a constituent comprises providing a steel having a composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

31. A process for preparing a free-machining steel, comprising the steps of:

a) providing a steel having MEA as a constituent;

b) precipitating manganese sulfide inclusions in the steel;

c) developing ferrite grain boundaries in the steel;

d) concentrating the MEA at the ferrite grain boundaries in an amount of at least about ten times the bulk MEA content of the steel;

e) machining the steel; and f) redistributing the MEA in the steel;

wherein the MEA is selected from the group consisting of tin, arsenic, antimony, and combinations thereof.

32. The process described in 31, wherein the step of redistributing the MEA in the steel comprises the steps of:

a) subjecting the steel to temperatures exceeding the austenite transformation temperature, $A_{C3}$, of the steel for at least about 0.4 hours per centimeter of equivalent diameter; and b) cooling the steel at a rate faster than about 1° C. per second through the temperature range of from about 700° C. to about 400° C. to avoid reconcentrating the MEA at the ferrite grain boundaries.

33. The process described in claim 31, wherein the step of precipitating manganese sulfide inclusions in the steel comprises precipitating manganese sulfide inclusions of a type of at least one selected from the group of Type I manganese sulfide inclusions and Type II manganese sulfide inclusions.

34. The process described in claim 31, wherein the step of concentrating the MEA at the ferrite grain boundaries includes concentrating the MEA at the ferrite grain boundaries to a concentration of at least about 0.5 weight percent.

35. The process described in claim 31, wherein the step of concentrating the MEA at the ferrite grain boundaries comprises cooling the steel at a rate slower than about 1° C. per second through the temperature range of from about 700° C. to about 400° C. to concentrate the MEA at the ferrite grain boundaries.

36. The process described in claim 31, wherein the step of concentrating the MEA at the ferrite grain boundaries comprises holding the steel in a temperature range of about 425° C. to about 575° C. for a time sufficiently long to concentrate the MEA at the ferrite grain boundaries.

37. The process described in claim 36, wherein the time of holding the steel in the temperature range of about from 425° C. to about 575° C. is at least about 0.4 hours per centimeter of an equivalent diameter of the steel.

38. The process described in claim 31, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

39. The process described in claim 38 wherein the MEA is arsenic from about 0.03 to about 0.13 weight percent.

40. The process described in claim 38 wherein the MEA is antimony from about 0.015 to about 0.055 weight percent.

41. The process described in claim 32, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

42. The process described in claim 33, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

43. The process described in claim 34, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

44. The process described in claim 35, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

45. The process described in claim 36, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

46. The process described in claim 37, wherein the step of providing a steel having MEA as a constituent comprises providing a steel having a composition consisting essentially of, in weight percent, carbon up to about 0.25, copper up to about 0.5, manganese from about 0.01 to about 2, oxygen from about 0.003 to about 0.03, sulfur from about 0.002 to about 0.8, MEA, and a balance of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

47. The process described in claim 31, wherein the step of providing a steel having MEA as a constituent comprises providing a steel having a composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

48. The process described in claim 47 wherein the MEA is arsenic from about 0.03 to about 0.13 weight percent.

49. The process described in claim 47 wherein the MEA is antimony from about 0.015 to about 0.055 weight percent.

50. The process described in claim 32, wherein the step of providing a steel having MEA as a constituent comprises providing a steel having a composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

51. The process described in claim 33, wherein the step of providing a steel having MEA as a constituent comprises providing a steel having a composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

52. The process described in claim 34 wherein the step of providing a steel having MEA as a constituent comprises providing a steel having a composition consisting essentially of, in weight percent, aluminum up to about 0.005, carbon from about 0.01 to about 0.25, copper Up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

53. The process described in claim 35 wherein the step of providing a steel having MEA as a constituent comprises providing a steel having a composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

54. The process described in claim 36, wherein the step of providing a steel having MEA as a constituent comprises providing a steel having a composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

55. The process described in claim 37 wherein the step of providing a steel having MEA as a constituent comprises providing a steel having a composition consisting essentially of, in weight percent, aluminum up to about 0.005, carbon from about 0.01 to about 0.25, copper up to about 0.5, manganese from about 0.5 to about 1.5, nitrogen up to about 0.015, oxygen from about 0.003 to about 0.03, phosphorus from about 0.01 to about 0.15, silicon up to about 0.05, sulfur from about 0.2 to about 0.45, MEA, and a balance consisting of iron and incidental impurities, wherein the MEA is selected from the group consisting of tin from about 0.04 to about 0.08, arsenic from 0.03 to about 0.13, antimony from about 0.015 to about 0.055, and combinations thereof, and wherein a ratio of the manganese to the sulfur is from about 2.9 to about 3.4, and wherein a total of the sulfur plus the MEA plus the copper is no more than about 0.9 weight percent.

56. A free-machining steel produced by the process described in claim 9.

57. A free-machining steel produced by the process described in claim 10.

58. A free-machining steel produced by the process described in claim 11.

59. A free-machining steel produced by the process described in claim 12.

60. A free-machining steel produced by the process described in claim 13.

61. A free-machining steel produced by the process described in claim 14.

62. A free-machining steel produced by the process described in claim 15.

63. A free-machining steel produced by the process described in claim 16.

64. A free-machining steel produced by the process described in claim 17.

65. A free-machining steel produced by the process described in claim 18.

66. A free-machining steel produced by the process described in claim 19.

67. A free-machining steel produced by the process described in claim 20.

68. A free-machining steel produced by the process described in claim 21.

69. A free-machining steel produced by the process described in claim 22.

70. A free-machining steel produced by the process described in claim 23.

71. A free-machining steel produced by the process described in claim 24.

72. A free-machining steel produced by the process described in claim 25.

73. A free-machining steel produced by the process described in claim 26.

74. A free-machining steel produced by the process described in claim 27.

75. A free-machining steel produced by the process described in claim 28.

76. A free-machining steel produced by the process described in claim 29.

77. A free-machining steel produced by the process described in claim 30.

78. A free-machining steel produced by the process described in claim 31.

79. A free-machining steel produced by the process described in claim 32.

80. A free-machining steel produced by the process described in claim 33.

81. A free-machining steel produced by the process described in claim 34.

82. A free-machining steel produced by the process described in claim 35.

83. A free-machining steel produced by the process described in claim 36.

84. A free-machining steel produced by the process described in claim 37.

85. A free-machining steel produced by the process described in claim 38.

86. A free-machining steel produced by the process described in claim 39.

87. A free-machining steel produced by the process described in claim 40.

88. A free-machining steel produced by the process described in claim 41.

89. A free-machining steel produced by the process described in claim 42.

90. A free-machining steel produced by the process described in claim 43.

91. A free-machining steel produced by the process described in claim 44.

92. A free-machining steel produced by the process described in claim 45.

93. A free-machining steel produced by the process described in claim 46.

94. A free-machining steel produced by the process described in claim 47.

95. A free-machining steel produced by the process described in claim 48.

96. A free-machining steel produced by the process described in claim 49.

97. A free-machining steel produced by the process described in claim 50.

98. A free-machining steel produced by the process described in claim 51.

99. A free-machining steel produced by the process described in claim 52.

100. A free-machining steel produced by the process described in claim 53.

101. A free-machining steel produced by the process described in claim 54.

102. A free-machining steel produced by the process described in claim 55.

* * * * *

UNITED STATES PATENT AND TRADEMARK OFFICE

CERTIFICATE OF CORRECTION

PATENT NO. : 6,200,395 B1
DATED : March 13, 2001
INVENTOR(S) : Anthony J. DeArdo and C. Isaac Garcia It is certified that error appears in the above-identified patent and that said Letters Patent is hereby corrected as shown below:

Title page, Item 54 and Column 1, line 2,
In the title of the invention, "TIN ANTIMONY" should read -- TIN, ANTIMONY --.

Column 10,
Line 19, "1,5" should read -- 1.5 --.

Column 12,
Line 12, "ways Two" should read -- ways. Two --.

Column 14,
Line 20, "maybe" should read -- may be;
Line 53, delete the second occurrence of the words "were made".

Column 26,
Line 33, "Up" should read -- up --.

Signed and Sealed this

Twenty-sixth Day of February, 2002

*Attest:*

*Attesting Officer*

JAMES E. ROGAN
*Director of the United States Patent and Trademark Office*